US012281872B2

(12) United States Patent
DiChario

(10) Patent No.: US 12,281,872 B2
(45) Date of Patent: Apr. 22, 2025

(54) HYBRID FREE-FLOAT HANDGUARD

(71) Applicant: American Tactical, Inc., Summerville, SC (US)

(72) Inventor: Anthony DiChario, Eutawville, SC (US)

(73) Assignee: American Tactical, Inc., Summerville, SC (US)

( * ) Notice: Subject to any disclaimer, the term of this patent is extended or adjusted under 35 U.S.C. 154(b) by 0 days.

(21) Appl. No.: 17/982,684

(22) Filed: Nov. 8, 2022

(65) Prior Publication Data

US 2024/0151493 A1 May 9, 2024

(51) Int. Cl.
*F41C 23/16* (2006.01)

(52) U.S. Cl.
CPC ..... *F41C 23/16* (2013.01)

(58) Field of Classification Search
CPC ..... F41C 23/16
See application file for complete search history.

(56) References Cited

U.S. PATENT DOCUMENTS 2,642,689 A * 6/1953 Cline ..... F41C 23/02 24/607
3,061,965 A * 11/1962 Lewis ..... F41C 23/02 42/85
3,226,872 A * 1/1966 Pachmayr ..... F41C 23/02 42/85
3,861,070 A * 1/1975 Wild ..... F41C 23/16 42/85
5,692,654 A * 12/1997 Bell ..... F41C 23/02 24/2.5
5,711,102 A * 1/1998 Plaster ..... F41C 23/14 42/74
5,937,560 A * 8/1999 Beltz ..... F41A 23/06 42/94
6,301,817 B1 * 10/2001 Hogue ..... F41C 23/18 42/71.01
6,499,245 B1 * 12/2002 Swan ..... F41G 11/003 42/75.01

(Continued)

FOREIGN PATENT DOCUMENTS

KR 1020140022906 2/2014

*Primary Examiner* — Michelle Clement
(74) *Attorney, Agent, or Firm* — Woods Oviatt Gilman LLP; Katherine H. McGuire, Esq.

(57) ABSTRACT

A free-floating handguard for mounting onto a firearm includes a tubular polymer-based handguard body allowing passage of a barrel therethrough. The handguard body has a free-floating muzzle end and a clamping end engaging a barrel nut that secures the barrel to the firearm. A downwardly extending lobe is formed on the handguard body proximate the clamping end. The handguard body may further include either or both of a first metal insert and a second metal insert. The first metal insert may be embedded within a bottom wall of the downwardly extending lobe and releasably couple with a mounting feature on a firearm sling. The second metal insert may be embedded within the downwardly extending lobe and defines a threaded bore for receiving a threaded fastener therein. The threaded fastener and second metal insert may clamp the clamping end on the barrel nut to secure the handguard body on the firearm.

9 Claims, 6 Drawing Sheets

(56) References Cited

U.S. PATENT DOCUMENTS 6,598,330 B2 * 7/2003 Garrett ..... F41C 23/02 24/2.5
6,658,781 B1 * 12/2003 Bowen ..... F41C 23/16 42/72
7,363,740 B2 * 4/2008 Kincel ..... F41C 23/22 42/72
7,654,027 B1 * 2/2010 Grover ..... F16B 21/165 403/322.2
7,676,975 B2 * 3/2010 Phillips ..... F41C 23/16 42/72
7,716,864 B2 * 5/2010 Skrubis ..... F41A 3/66 42/71.01
7,775,150 B2 * 8/2010 Hochstrate ..... F41A 5/18 89/193
8,656,622 B2 * 2/2014 Peterson ..... F41C 23/14 42/75.03
8,793,916 B2 * 8/2014 Rogers ..... F41C 23/02 24/2.5
9,310,146 B2 * 4/2016 Gibbens ..... F41C 23/16
9,377,274 B2 * 6/2016 Kincel ..... F41C 23/16
9,447,815 B2 * 9/2016 Roberts ..... F41C 33/002
9,513,087 B2 * 12/2016 Barger ..... F41G 11/003
9,557,138 B2 * 1/2017 Alford ..... F41C 33/002
9,777,975 B2 * 10/2017 Folkestad, II ..... F41A 3/66
10,001,340 B1 * 6/2018 Oglesby ..... F41C 23/18
10,001,341 B2 * 6/2018 Geissele ..... F41C 27/22
10,371,482 B2 * 8/2019 Roberts ..... F41C 23/02
10,480,897 B2 * 11/2019 Keeney ..... F41C 27/00
10,724,825 B2 * 7/2020 Keeney ..... F41C 23/16
11,073,358 B2 * 7/2021 Chin ..... F16B 45/002
11,131,525 B2 * 9/2021 Williams ..... F41G 11/003
11,499,796 B2 * 11/2022 Martini ..... F41A 21/34
12,066,272 B2 * 8/2024 Mayberry ..... F41G 11/004
2009/0056191 A1 * 3/2009 Battaglia ..... F41C 23/16 42/71.01
2010/0170133 A1 7/2010 Swan
2011/0214329 A1 * 9/2011 Green ..... F41C 27/00 42/90
2011/0247254 A1 * 10/2011 Barnes ..... F41A 21/48 42/75.01
2013/0068089 A1 * 3/2013 Brown ..... F41G 1/02 89/193
2013/0333168 A1 * 12/2013 Burnsed, Jr. ..... F41C 23/02 24/573.11
2014/0076149 A1 3/2014 Adams
2014/0090550 A1 4/2014 Wilcox et al.
2014/0190055 A1 * 7/2014 Warburton ..... F41C 23/20 42/71.01
2015/0285585 A1 * 10/2015 Hewes ..... F41C 23/16 42/71.01
2016/0305739 A1 * 10/2016 Garst ..... F41C 23/18
2016/0356304 A1 * 12/2016 Roberts ..... F41C 23/02
2018/0195832 A1 * 7/2018 Faxon ..... F41C 23/16
2020/0263951 A1 * 8/2020 Bergman ..... F41C 23/02
2020/0378702 A1 * 12/2020 DiChario ..... F41A 5/20
2021/0341253 A1 * 11/2021 McPhee ..... F16B 21/165
2022/0290943 A1 * 9/2022 Cahill ..... F41C 23/14
2023/0221092 A1 * 7/2023 Underwood ..... F41A 21/48 42/71.01
2023/0366653 A1 * 11/2023 Williams ..... F41G 11/003
2024/0118053 A1 * 4/2024 Moretti ..... F41C 23/14
2024/0151493 A1 * 5/2024 DiChario ..... F41C 23/16

* cited by examiner

HYBRID FREE-FLOAT HANDGUARD

FIELD OF THE INVENTION

The present invention relates to modular modern sporting firearms, and more particularly, to free-floating handguard for use with a modular modern sporting shotgun or rifle. Specifically, the present invention relates to a hybrid free-floating handguard comprising a polymer-based handguard body and including one or more embedded metal substructures strategically positioned at points of stress within the handguard.

BACKGROUND OF THE INVENTION

There are a number of available automatic and semi-automatic firearms for use by military personnel and civilians. While fully automatic firearms are generally illegal for use by the civilian population, many of the components which constitute an automatic firearm are the same as those found within legal semi-automatic models. Arguably the most popular semi-automatic modern sporting firearm used by civilians, particularly within the United States, is the AR-15. The AR-15 is the semi-automatic variant of the fully automatic M16 firearm used by United States military personnel. While AR-15 is a registered trademark of Colt Industries, a number of additional manufacturers manufacture clones of the AR-15 and market these clones under separate trademarks. While used throughout the specification, it is to be understood that the term AR-15 is meant to include not only those firearms manufactured by Colt Industries, but also those additional clones and any variants thereof.

The AR-15 and M16 are designed as modular rifles generally comprising a buttstock, lower receiver, upper receiver and barrel assembly configured to fire 0.223 Remington or 5.56×45 mm NATO military ammunition. Each component is separable from one another which affords firearm owners the opportunity to customize the firearm with after-market components such as barrels of differing lengths, upper receivers designed to handle different calibers of ammunition, flashlights, handguards, grenade or flare launchers, flash or sound suppressors, grips, front or rear sights, and others.

One common accessory equipped on most automatic and semi-automatic firearms, like the AR-15, is a handguard. Handguards generally shield a user's hand from the firearm's barrel which may become hot during repeated firing of rounds. A handguard may also provide various mounting features designed to allow further accessorizing of the firearm to include such things as forward and rear sights, flashlights, carry handles and sling mounts, scopes and scope mounts, bipod and tripod supports, and the like.

Currently, handguards are generally constructed of metal, such as aluminum, which provides the structural integrity to support the weight of the various accessories mounted onto the handrail, while also being able to withstand the cyclical heating/cooling of the handguard as the firearm alternates between active firing and rest. Polymer-based handguards are also available, but these handguards suffer part failures due to the weight/heat subjected to the polymer material. Polymer handguards are also not available as free-floating handguards and therefore do not provide for the improved accuracy, comfort and aesthetics offered by a free-floating handguard.

Thus, there is a need for a lighter weight and less expensive free-floating handguard that meets and/or exceeds the performance of presently available free-floating metal handguards. The present invention addresses these and other needs.

BRIEF SUMMARY OF THE INVENTION

In accordance with an aspect of the present invention, an exemplary embodiment may be directed to a free-floating handguard configured to be mounted onto a modular sporting firearm. The free-floating handguard comprises a tubular polymer-based handguard body configured to allow passage of a barrel therethrough. The handguard body has an open free-floating muzzle end and an opposing clamping end configured to detachably engage a barrel nut that secures the barrel to the firearm. A downwardly extending lobe is integrally formed on the tubular polymer-based handguard body proximate the clamping end of the handguard body and a first metal insert is embedded within a bottom wall of the downwardly extending lobe. The first metal insert is adapted to releasably couple with a corresponding mounting feature on a firearm sling. The first metal insert may be a swivel socket.

In another aspect, the downwardly extending lobe may include a vertical slot defined therein which extends from the clamping end to adjacent to but a spaced distance from the first metal insert. The downwardly extending lobe includes at least one horizontal through bore proximate the clamping end. A second metal insert is embedded within the downwardly extending lobe and defines a threaded bore. The threaded bore is aligned with the at least one horizontal through bore. The at least one horizontal through bore is configured to receive a threaded fastener therein and the threaded fastener is configured to threadably engage the threaded bore of the second metal insert whereby the vertical slot is at least partially closed so as to clamp the clamping end of the handguard body on the barrel nut to secure the handguard body on the firearm.

In still further aspects, the tubular polymer-based handguard body may be comprised of one or both of nylon and ABS and further impregnated with one or more of carbon fiber, glass or aramid. The tubular polymer-based handguard body may also include a mounting feature defined thereon and the mounting feature may be a picatinny rail.

In yet another aspect, the tubular polymer-based handguard body includes a top wall defining first and second gas regulator apertures configured to receive a selectively adjustable gas regulator assembly coupled to the barrel. The first gas regulator aperture is configured to allow passage of a gas regulator shaft to pass through the top wall and the second gas regulator aperture includes a third metal insert embedded therein. The third metal insert may be configured to threadably receive a detent therein.

In a further aspect of the present invention, an alternative exemplary embodiment may be directed to a free-floating handguard configured to be mounted onto a modular sporting firearm and include a tubular polymer-based handguard body configured to allow passage of a barrel therethrough. The handguard body may have an open free-floating muzzle end and an opposing clamping end configured to detachably engage a barrel nut that secures the barrel to the firearm. A downwardly extending lobe may be integrally formed on the tubular polymer-based handguard body proximate the clamping end of the handguard body. The downwardly extending lobe may define a horizontal through bore therein and a first metal insert may be embedded within the downwardly extending lobe. The first metal insert defines a threaded bore and wherein the threaded bore is aligned with the horizontal through bore such that the horizontal through bore is configured to receive a threaded fastener therein with the threaded fastener configured to threadably engage the threaded bore of the first metal insert so as to clamp the clamping end of the handguard body on the barrel nut to secure the handguard body on the firearm.

In another aspect of the alternative embodiment, the downwardly extending lobe may include a vertical slot defined therein. The horizontal through bore is in communication with the vertical slot insert whereby the vertical slot is at least partially closed upon the threaded engagement of the threaded fastener within the horizontal through bore with the threaded bore. The tubular polymer-based handguard body may also include a top wall defining first and second gas regulator apertures configured to receive a selectively adjustable gas regulator assembly coupled to the barrel. The first gas regulator aperture may be configured to allow passage of a gas regulator shaft to pass through the top wall and the second gas regulator aperture may include a second metal insert embedded therein, wherein the second metal insert is configured to threadably receive a detent therein.

Yet another exemplary embodiment is directed to a free-floating handguard configured to be mounted onto a modular sporting firearm and including a tubular polymer-based handguard body configured to allow passage of a barrel therethrough. The handguard body has an open free-floating muzzle end and an opposing clamping end configured to detachably engage a barrel nut that secures the barrel to the firearm. A top wall defines first and second gas regulator apertures configured to receive a selectively adjustable gas regulator assembly coupled to the barrel. The first gas regulator aperture is configured to allow passage of a gas regulator shaft to pass through the top wall of the handguard body, and the second gas regulator aperture includes a first metal insert embedded therein. The first metal insert is configured to threadably receive a detent therein.

Additional objects, advantages and novel features of the present invention will be set forth in part in the description which follows, and will in part become apparent to those in the practice of the invention, when considered with the attached figures.

BRIEF DESCRIPTION OF THE DRAWINGS

The accompanying drawings form a part of this specification and are to be read in conjunction therewith, wherein like reference numerals are employed to indicate like parts in the various views, and wherein.

DETAILED DESCRIPTION OF THE INVENTION

Most modern sporting firearms are configured to be operated as rifles and include a rifled barrel and are chambered to receiver and fire rifle cartridges. By way of example, the most ubiquitous civilian modern sporting weapon, the AR-15 style firearm, is generally chambered for standardized rounds such as the Remington 0.223 cartridge or the 5.56×45 mm NATO military cartridge. The major components of AR-15 style firearms have been standardized, with such standardization being generally referred to as meeting United States Military Standards or, more commonly as being "mil-spec". Specifically, as used herein, the terms "mil-spec" and "mil-spec M16/AR-15" shall refer to the structural specificities defined by the United States Department of Defense as of the date of filing of the instant United States patent application. Modern sporting weapons, such as the AR-15 style firearm, have also been modified to chamber and fire 0.410 bore shotgun shells as generally shown and described within commonly owned U.S. Pat. Nos. 10,578,381 and 11,125,516, the entirety of which are hereby incorporated by reference.

Figure 1:
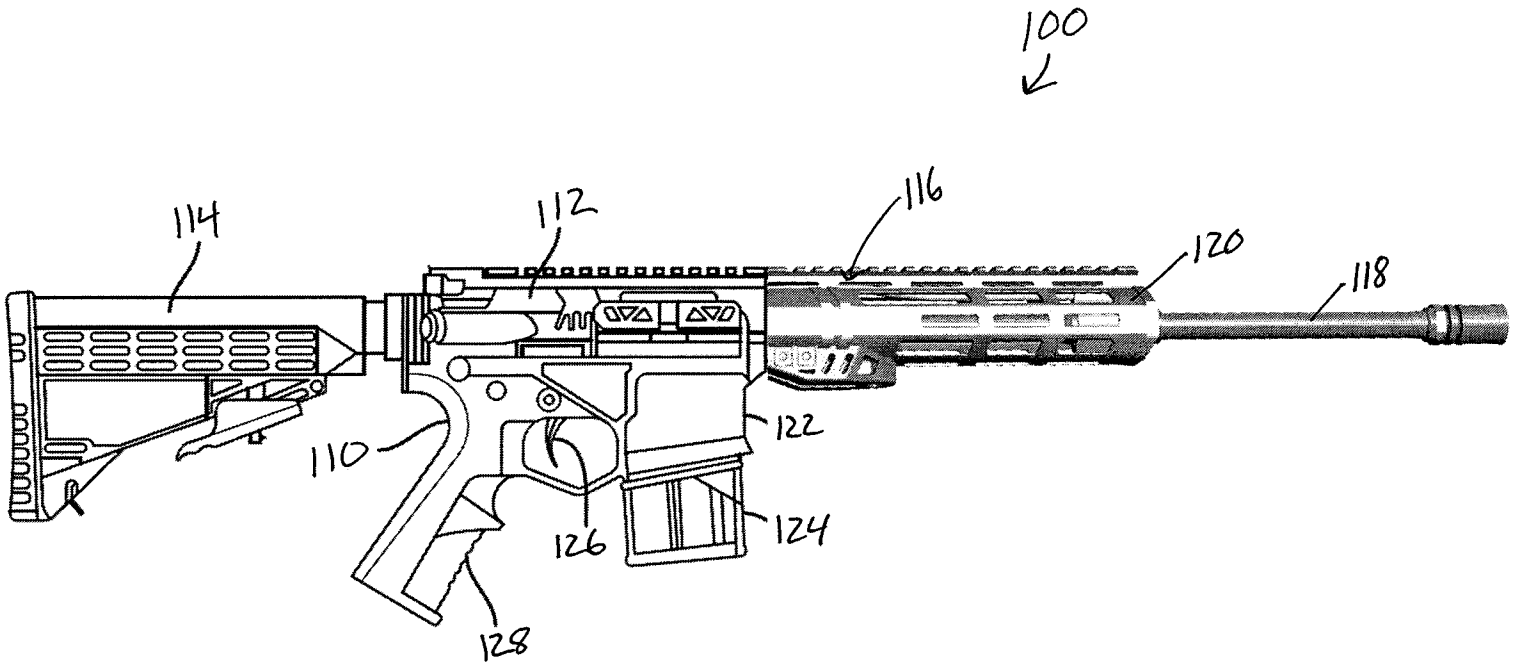
FIG. 1 is a side view of a modular firearm equipped with an exemplary embodiment of a free-floating handguard in accordance with an aspect of the present invention.

Referring to the drawings in detail, and specifically to FIG. 1, a firearm, such as the AR-15, is generally indicated by reference numeral 100. Firearm 100 may be a modular firearm consisting of a number of components and subcomponents. Major components of firearm 100 may include lower receiver assembly 110, upper receiver assembly 112, buttstock assembly 114 and barrel assembly 116. To assemble a completed firearm, upper receiver assembly 112 is coupled to lower receiver assembly 110 while buttstock assembly 114 is connected to the lower receiver assembly 110 and barrel assembly 116 is mounted onto upper receiver assembly 112. Barrel assembly 116 includes, for instance and without limitation, a barrel 118 and optionally as shown, a handguard 120. Lower receiver assembly 110 is configured to include a magazine well 122 adapted to slidably receive a magazine therein 124. The magazine may carry one more cartridges, bullets or shells which may be serially loaded within a chamber (not shown) in upper receiver assembly 112. Activation of the firing mechanism (not shown) is controlled by trigger 126. A grip 128 (such as a pistol grip, as shown) allows the user to aim and control the firearm while placing the user's trigger index finger in close proximity to trigger 124. In this manner, the user can aim the firearm to the target and extend the trigger index finger to engage the trigger without losing control or accuracy of the firearm.

With reference to FIGS. 2-6, an exemplary embodiment of a free-floating handguard 120 generally includes a handguard body 130 having a top wall 130*a*, bottom wall 130*b* and opposing sidewalls 130*c*, 130*d*, all defining a barrel opening 131 (see FIGS. 5 and 6) configured to allow passage of barrel 118 therethrough. Handguard body 130 has an open free-floating muzzle end 132 and an opposing clamping end 134 configured to detachably engage a barrel nut (not shown) that secures barrel 118 to upper receiver assembly 112. Top wall 130*a* may be configured to include one or more mounting features 133 thereon for securing user-selected accessories onto the firearm. By way of example and without limitation, mounting features 133 may comprise a picatinny rail. It should be further noted that, while not shown, bottom wall 130*b* and/or one or both sidewalls 130*c*, 130*d* may also be configured to include mounting features such as a respective picatinny rail. In one aspect of the present invention, handguard body 130 may be tubular in shape and be fabricated from a polymer base. By way of example and without limitation thereto, the polymer base may comprise one or both of nylon or acrylonitrile butadiene styrene (ABS), and may further be impregnated with one or more additional materials, such as but not limited to carbon fiber, glass, aramid or other suitable reinforcing fiber material. In one aspect, the reinforced polymer material provides the desired cost and weight reductions of polymers while also providing the strength and reliability of metal materials.

Handguard body 130 may further include an integrally formed, downwardly extending lobe 136 proximate clamping end 134. In one embodiment of the present invention, downwardly extending lobe 136 may include a first metal insert 138, such as a female quick disconnect/detach (QD) fitting or mount, or a swivel socket embedded within the polymer base material of downwardly extending lobe 136. First metal insert 138 may open to either the side wall (e.g. outer surface 136*a*) or, more preferably, toward the bottom wall 136*b* of downwardly extending lobe 136. First metal insert 138 may then releasably couple with a corresponding mounting feature on a firearm sling, such as a male QD fitting.

Figure 6:
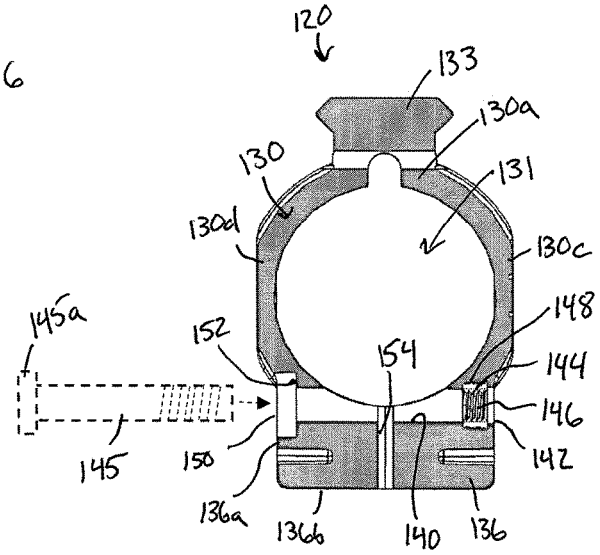
FIG. 6 is a cross-section view the of the exemplary free-floating handguard generally taken along line 6-6 shown in FIG. 3.

Additionally or alternatively and with particular reference to FIG. 6, downwardly extending lobe 136 may include one or more horizontal through bores 140 proximate clamping end 134 of handguard body 130. A first end 142 of each through bore 140 may include a respective second metal insert 144 embedded within the polymer base comprising the downwardly extending lobe 136. Second metal insert 144 may define a threaded internal bore 146 which is configured to threadably engage with male threads of corresponding fastener, such as a compressing bolt 145 (FIG. 6). In one aspect, the exterior surface 148 of second metal insert 144 may be figured or otherwise possess features which fixedly secure second metal insert within the polymer-based material of the downwardly extending lobe 136 such that second metal insert 144 does not rotate or translate upon engagement with its corresponding fastener 145. Second end 150 of each through bore 140 may include a chamfered or recessed edge 152 configured to receive the head 145*a* of fastener 145 such that fastener 145 sits flush with, or slightly depressed from, the outer surface 136*a* of downwardly extending lobe 136.

Figure 2:
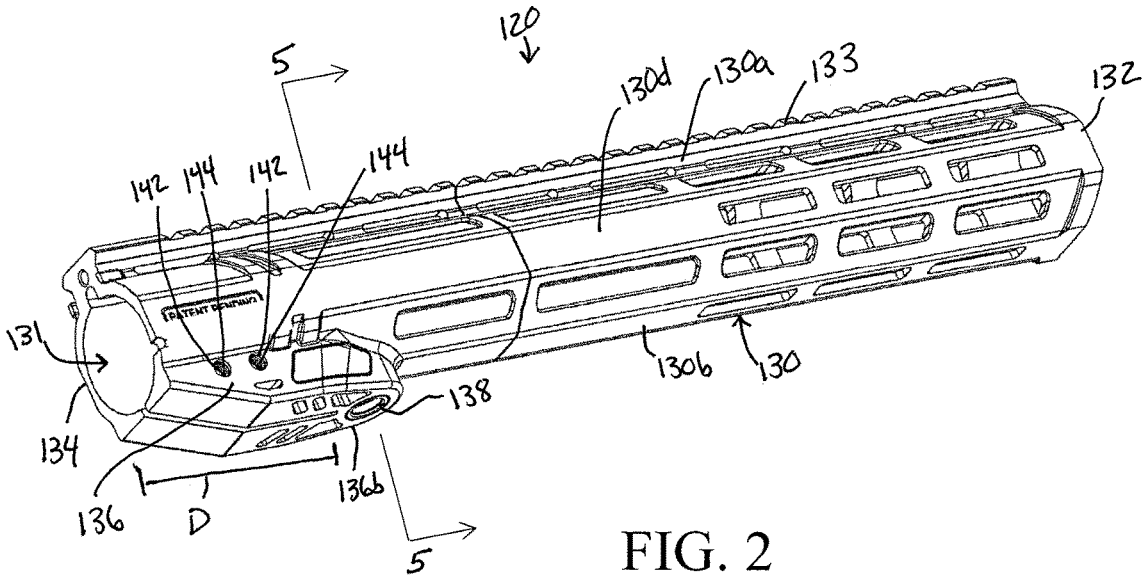
FIG. 2 is a bottom right perspective view of the exemplary free-floating handguard shown in FIG. 1.
Figure 3:
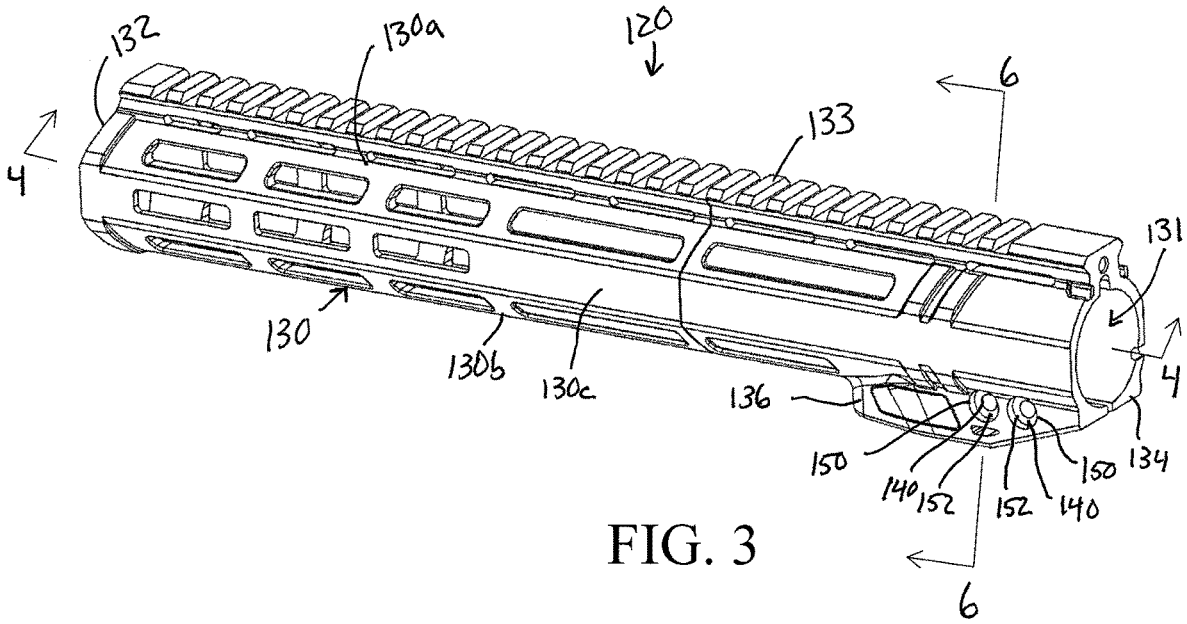
FIG. 3 is a top left perspective view of the exemplary free-floating handguard shown in FIG. 1.
Figure 4:
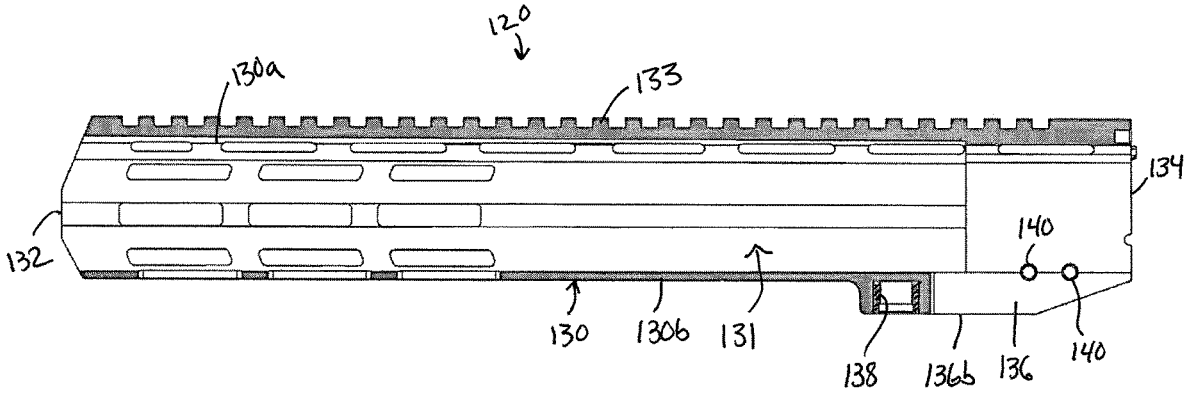
FIG. 4 is a cross-section view the of the exemplary free-floating handguard generally taken along line 4-4 shown in FIG. 3.
Figure 5:
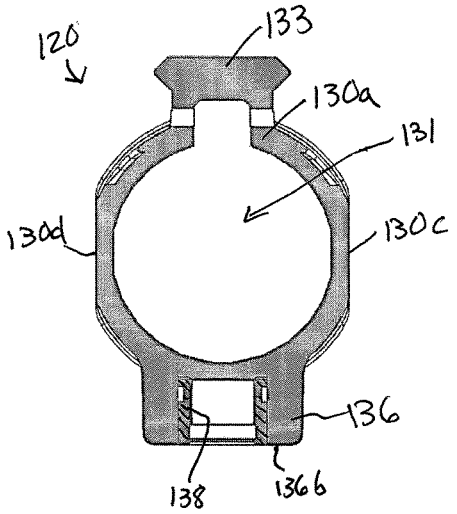
FIG. 5 is a cross-section view of the exemplary free-floating handguard generally taken along line 5-5 shown in FIG. 2.

With reference to FIGS. 2 and 6, downwardly extending lobe 136 may further include a vertical slot 154 defined therein. Vertical slot 154 may extend vertically from barrel opening 131 to bottom wall 136*b* of downwardly extending lobe 136 and longitudinally from clamping end 134 to an intermediate distance D along downwardly extending lobe 136, such as but not limited to proximate first metal insert 138. Each through bore 140 is configured to communicate with vertical slot 154. Thus, threaded fastener 145 may be inserted within through bore 140 to threadably engage with threads 146 of second metal insert 144. Tightening of threaded fastener 145 within second metal insert 144 causes vertical slot 154 to at least partially close or otherwise deform so that clamping end 134 of handguard body 130 engages with the barrel nut which is securing barrel 118 to upper receiver assembly 112. Handguard body 130 may thus be secured on firearm 100.

Figure 7:
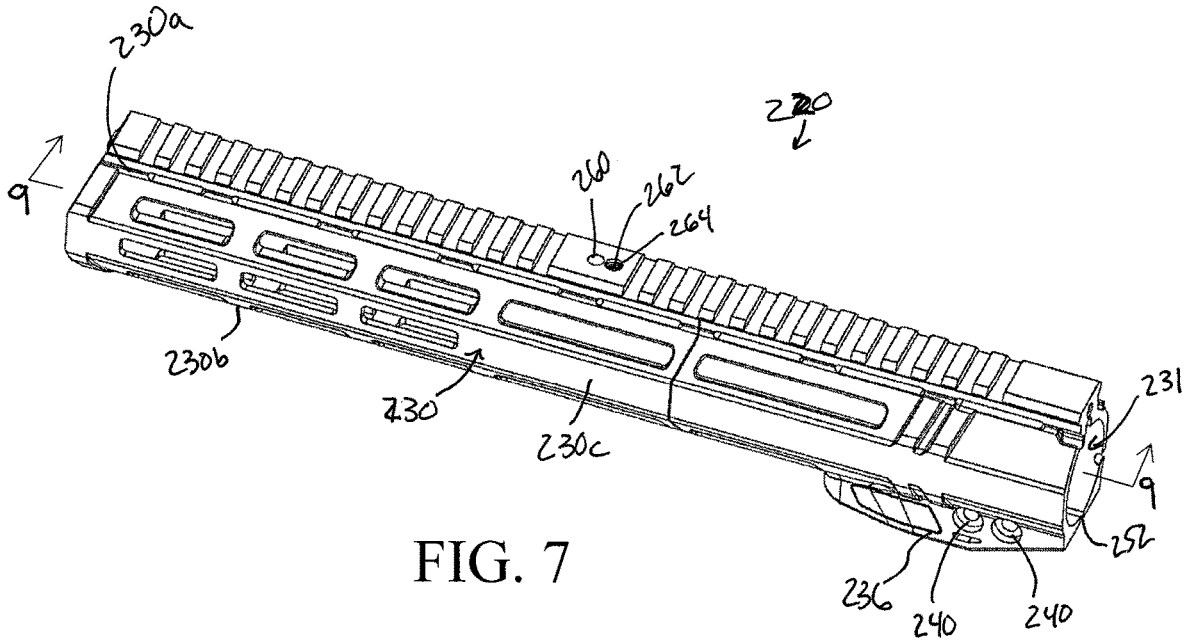
FIG. 7 is a top left perspective view of an alternative exemplary embodiment of a free-floating handguard in accordance with an aspect of the present invention.
Figure 8:
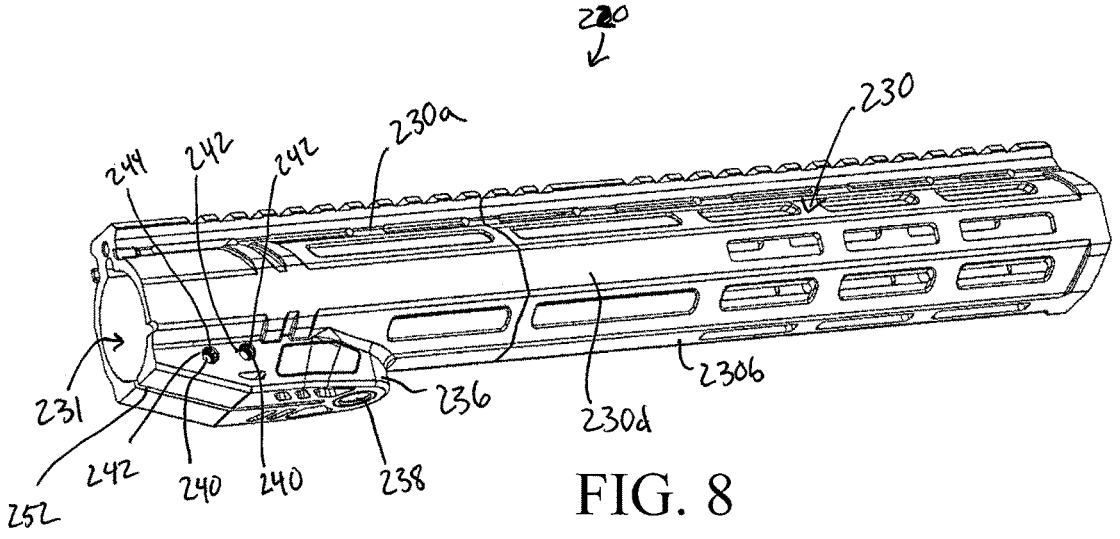
FIG. 8 is a bottom right perspective view of the alternative exemplary free-floating handguard shown in FIG. 7.
Figure 9:
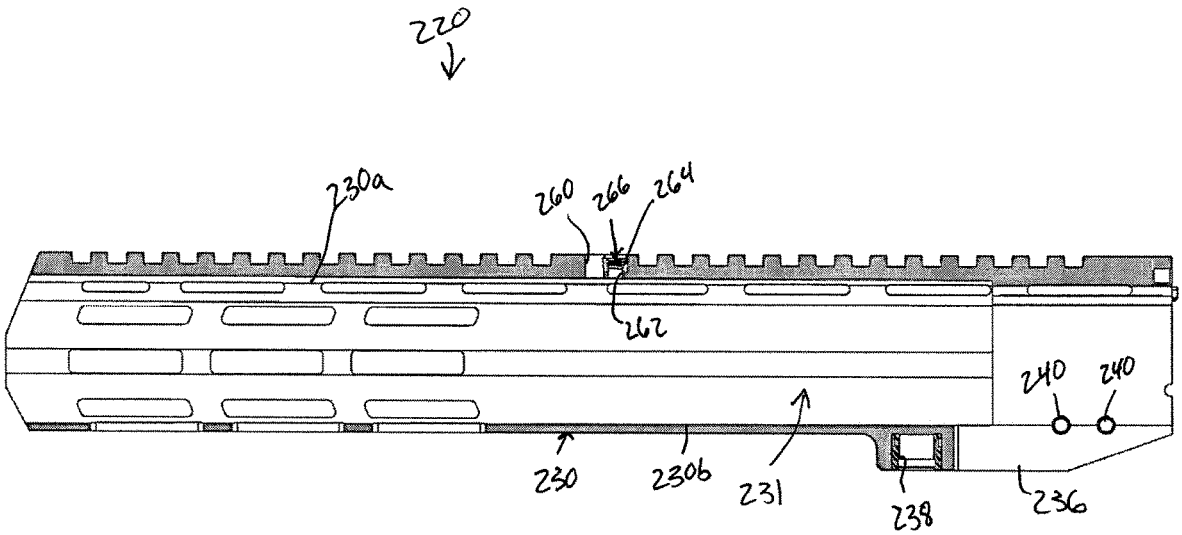
FIG. 9 is a cross-section view of the alternative exemplary free-floating handguard generally taken along line 9-9 shown in FIG. 7.

Turning now to FIGS. 7-9, an alternative embodiment of a free-floating handguard 220 is generally identical to free-floating handguard 120 described above but for a modified top wall 230*a* of handguard body 230. Free-floating handguard 220 may be configured for use with an AR-15 style firearm that has been modified to chamber and fire 0.410 bore shotgun shells, similar to that disclosed within commonly owned U.S. Pat. No. 11,125,516 ("the '516 Patent").

As shown in FIGS. 7 and 8, free-floating handguard 220 includes a handguard body 230 having a top wall 230*a*, bottom wall 230*b* and opposing sidewalls 230*c*, 230*d*, all defining a barrel opening 231 configured to allow passage of a barrel therethrough. Handguard body 230 may further include an integrally formed, downwardly extending lobe 236 proximate clamping end 234. In one embodiment of the present invention, downwardly extending lobe 236 may include a first metal insert 238. Additionally or alternatively, downwardly extending lobe 236 may also include one or more horizontal through bores 240 proximate clamping end 234 of handguard body 230. A first end 242 of each through bore 240 may include a respective second metal insert 244 embedded within the polymer base comprising the downwardly extending lobe 236. Vertical slot 254 may extend vertically from barrel opening 231 to bottom wall 236*b* of downwardly extending lobe 236 and longitudinally from clamping end 234 to an intermediate distance $D_2$ along downwardly extending lobe 236.

As shown most clearly in FIGS. 7 and 9, top wall 230*a* has been modified with respect to top wall 130*a* so as to include first and second gas regulator apertures 260, 262 defined therein for receiving a gas regulator apparatus, similar to that disclosed within the '516 Patent. First gas regulator aperture 260 traverses the thickness of top wall 230*a* and is configured to allow passage of a threaded gas regulator shaft therethrough. Second gas regulator aperture 262 may include a third metal insert 264 embedded within polymer material comprising handguard body 230. Third metal insert 264 may define a threaded bore 266 configured to threadably receive a detent therein, wherein the detent works in combination with the gas regulator shaft to control the gas pressure of the recharge gas for proper cycling of the bolt carrier group of the firearm. Alternatively, third metal insert 264 may comprise the detent such that the detent may be embedded within handguard body 230 during manufacture.

Figure 10A:
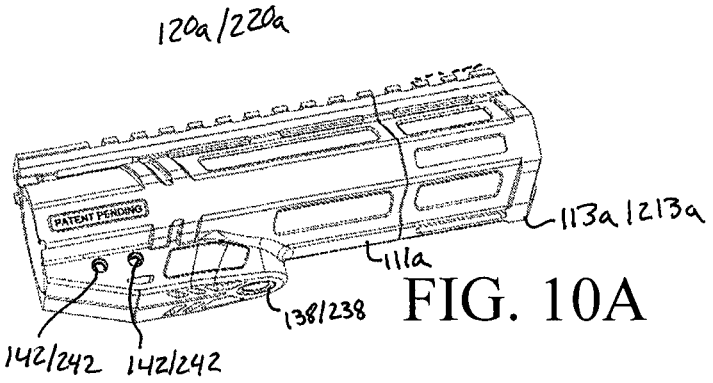
FIGS. 10A-10D show a series of exemplary free-floating handguards having differing lengths for use with firearms having differing barrel lengths and/or user preferences.
Figure 10B:
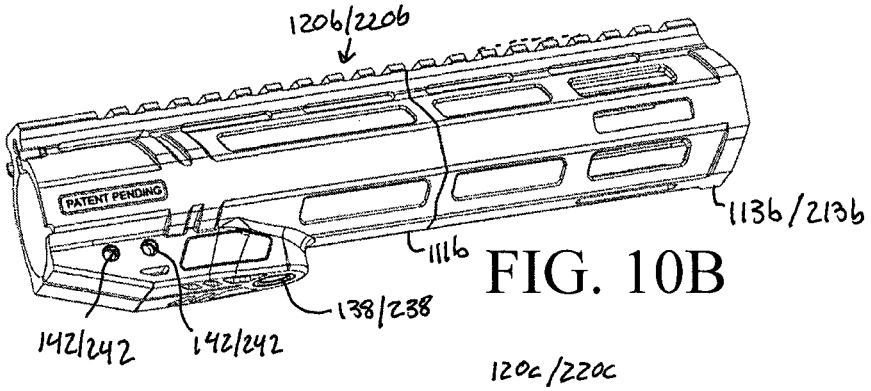
Figure 10C:
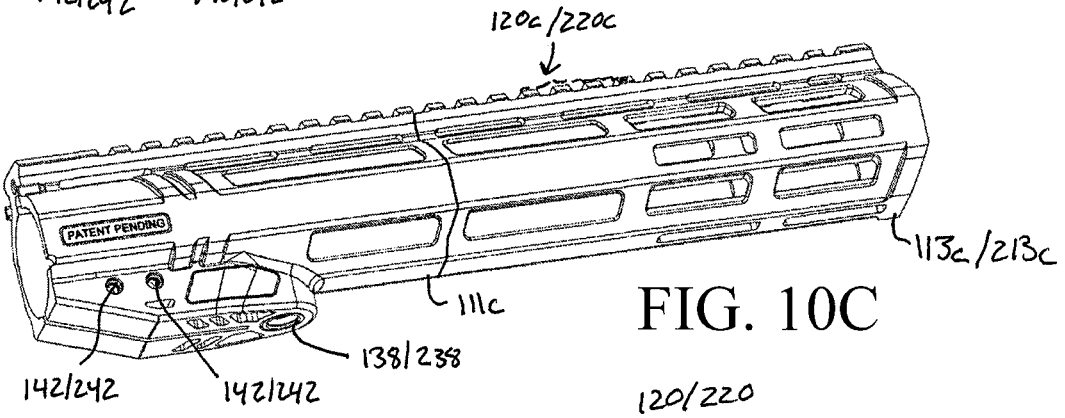
Figure 10D:
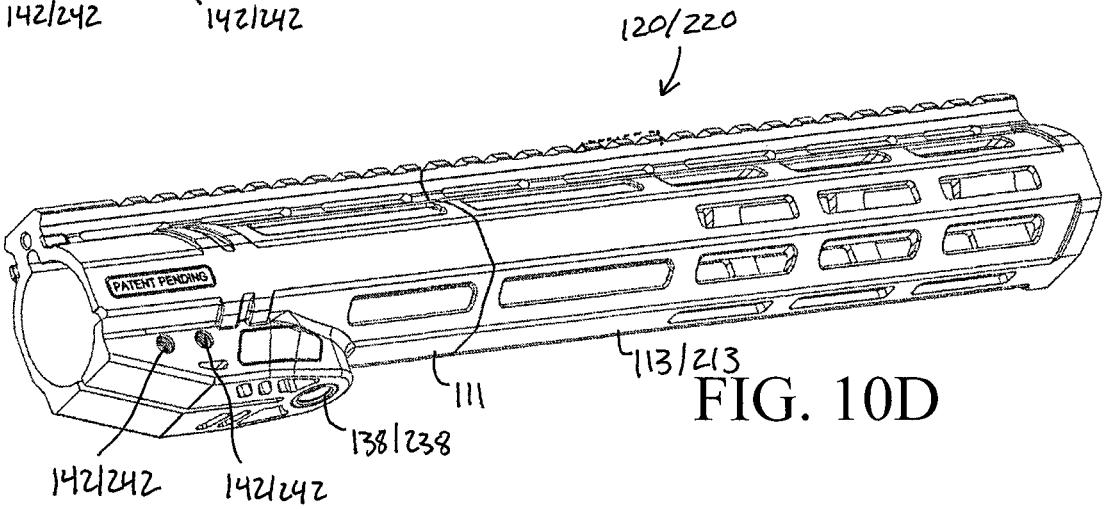

Turning now to FIGS. 10A-10D, a series of exemplary free-floating handguards having differing lengths for use with firearms having differing barrel lengths or user preferences is shown. By way of example and without limitation, FIG. 10A shows a nominal 7 inch free-floating handguard 120*a*/220*a*; FIG. 10B shows a nominal 9 inch free-floating handguard 120*b*/220*b*; FIG. 10C shows a nominal 11 inch free-floating handguard; and FIG. 10D shows nominal 13 inch free-floating handguard 120/220 which were described above with regard to FIGS. 1-9.

As can be seen, each of the free-floating handguards includes a common portion 111-111*c*, respectively and a variable portion 113-113*c*, respectively. Common portions 111-111*c* may be formed by a common mold having a nominal length of about 5 inches. Common portions 111-111*c* are constructed to include one or both of first and second metal inserts 138/238 and 142/242 therein. Variable portions 113-113*c* may be used to extend the free-floating handguard to a required or user-selected length, with variable portions 113-113*c* having any desired length, and as shown by example only, can be either 2 inches, 4 inches, 6 inches or 8 inches, although other lengths are envisioned.

Common portions 111-111*c* may be formed as separate subunits than subunits comprising variable portions 113-113*c*, with the subunits coupled together to form a completed handguard, or more preferably, a respective common portion 111-111*c* and a respective variable portion 113-113*c* may be fabricated as a monolithic unit. When used with the 410 upper receiver and barrel assembly described in the commonly owned '516 Patent, variable portions 213-213*c* are configured to include the first and second gas regulator apertures 260, 262 and third metal insert 264 (see e.g., FIGS. 7 and 9).

It should be noted that while described throughout the description and claims as being a "metal insert", each of first, second and/or third inserts 138, 144, 264 may be any suitable material, including and without limitation thereto, a metal, an alloy, a composite metal or any combination thereof. In one embodiment, inserts 138, 144, 264 may be stainless steel, brass or copper. Inserts 138, 144, 264 may all be comprised of the same material or be of different materials, as desired or necessary. It should be further noted that fastener (compressing bolt) 145 may be fabricated of a material identical to second insert 144 to avoid the possibility of corrosion or pitting.

Although the present invention has been described in considerable detail with reference to certain aspects thereof, other versions are possible. Therefore, the spirit and scope of the appended claims should not be limited to the description of the aspects contained herein.

All features disclosed in the specification, including the claims, abstract, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A free-floating handguard configured to be mounted onto a modular sporting firearm, the free-floating handguard comprising:

a) a tubular polymer-based handguard body configured to allow passage of a barrel therethrough, the handguard body having an open free-floating muzzle end and an opposing clamping end configured to detachably engage a barrel nut that secures the barrel to the firearm;

b) a downwardly extending lobe integrally formed on the tubular polymer- based handguard body proximate the clamping end of the handguard body; and c) a first metal insert embedded within a bottom wall of the downwardly extending lobe, wherein the first metal insert is adapted to releasably couple with a corresponding mounting feature on a firearm sling, wherein the downwardly extending lobe includes a vertical slot defined therein which extends from the clamping end to adjacent to but a spaced distance from the first metal insert, and wherein the downwardly extending lobe includes at least one horizontal through bore proximate the clamping end; and wherein the free-floating handguard further comprises:

d) a second metal insert embedded within the downwardly extending lobe, wherein the second metal insert defines a threaded bore and wherein the threaded bore is aligned with the at least one horizontal through bore, wherein the at least one horizontal through bore is configured to receive a threaded fastener therein, wherein the threaded fastener is configured to threadably engage the threaded bore of the second metal insert whereby the vertical slot is at least partially closed so as to clamp the clamping end of the handguard body on the barrel nut to secure the handguard body on the firearm.

2. The free-floating handguard of claim 1 wherein the first metal insert is a swivel socket.

3. The free-floating handguard of claim 1 wherein the tubular polymer-based handguard body is comprised of one or both of nylon and ABS and further impregnated with one or more of carbon fiber, glass or aramid.

4. The free-floating handguard of claim 1 wherein the tubular polymer-based handguard body includes a mounting feature defined thereon.

5. The free-floating handguard of claim 4 wherein the mounting feature is a picatinny rail.

6. The free-floating handguard of claim 1 wherein the tubular polymer-based handguard body includes a top wall defining first and second gas regulator apertures configured to receive a selectively adjustable gas regulator assembly coupled to the barrel.

7. The free-floating handguard of claim 6 wherein the first gas regulator aperture is configured to allow passage of a gas regulator shaft to pass through the top wall, and wherein the second gas regulator aperture includes a third metal insert embedded therein, wherein the third metal insert is configured to threadably receive a detent therein.

8. The free-floating handguard of claim 1 wherein the tubular polymer-based handguard body includes a top wall defining first and second gas regulator apertures configured to receive a selectively adjustable gas regulator assembly coupled to the barrel.

9. The free-floating handguard of claim 8 wherein the first gas regulator aperture is configured to allow passage of a gas regulator shaft to pass through the top wall, and wherein the second gas regulator aperture includes a third metal insert embedded therein, wherein the third metal insert is configured to threadably receive a detent therein.

* * * * *